US011735882B2

(12) United States Patent
Houser et al.

(10) Patent No.: US 11,735,882 B2
(45) Date of Patent: Aug. 22, 2023

(54) TERMINAL APPLICATOR TO CASSETTE MOUNTING APPARATUS

(71) Applicant: TE Connectivity Services GmbH, Schaffhausen (CH)

(72) Inventors: Matthew Steven Houser, Middletown, PA (US); David Michael Stull, Middletown, PA (US); Jack DePasquale, Middletown, PA (US)

(73) Assignee: TE Connectivity Solutions GmbH, Schaffhausen (CH)

( * ) Notice: Subject to any disclaimer, the term of this patent is extended or adjusted under 35 U.S.C. 154(b) by 0 days.

(21) Appl. No.: 17/342,940

(22) Filed: Jun. 9, 2021

(65) Prior Publication Data

US 2022/0399691 A1 Dec. 15, 2022

(51) Int. Cl.
*H01R 43/055* (2006.01)
*H01R 43/042* (2006.01)

(52) U.S. Cl.
CPC ..... *H01R 43/055* (2013.01); *H01R 43/0428* (2013.01)

(58) Field of Classification Search
CPC ..... H01R 43/0428; H01R 43/045; H01R 43/048; H01R 43/055; Y10T 29/49185; Y10T 49/53235; Y10S 72/712
See application file for complete search history.

(56) References Cited

U.S. PATENT DOCUMENTS 5,577,318 A * 11/1996 Smith ..... H01R 43/048 29/33 M
2020/0127428 A1* 4/2020 Weber ..... H01R 43/055

FOREIGN PATENT DOCUMENTS

| | | |
|---|---|---|
| CN | 204277864 U | 4/2015 |
| DE | 10154330 A1 | 5/2003 |
| JP | S4999426 U | 8/1974 |

OTHER PUBLICATIONS

International Search Report, International App. No. PCT/IB2022/055389 International Filing Date Jun. 9, 2022.

* cited by examiner

*Primary Examiner* — Peter Dungba Vo
*Assistant Examiner* — Joshua D Anderson

(57) ABSTRACT

A system for mounting an electrical terminal applicator to a cassette containing a plurality of terminals is provided. The system includes a support plate for fixedly attaching to the applicator, and a yoke releasably attached to the support plate. The yoke and support plate define an attachment therebetween providing at least one degree of freedom of motion of the support plate relative to the yoke in an attached state. The yoke is further configured to be movably mounted to the cassette with at least one additional degree of freedom of motion.

15 Claims, 12 Drawing Sheets

TERMINAL APPLICATOR TO CASSETTE MOUNTING APPARATUS

FIELD OF THE INVENTION

The present disclosure relates to crimping systems, and more particularly, to an improved system or apparatus for mounting a terminal applicator to a terminal holding cassette.

BACKGROUND

Crimping or terminating systems for securing a terminal onto an electrical conductor typically include an applicator configured to feed terminals from an attached cassette into position for crimping the terminals onto the conductor. The applicator must be accurately mounted with respect to a crimping press or a terminator (also referred to as a lead-maker), which provides the force necessary for crimping the terminal. The cassette, which holds a reel containing a plurality of terminals, is removably coupled to the applicator, and can be interchanged with other cassettes in order to change a type of terminal supplied to the applicator. Prior to use, the applicator and the cassette combination are typically coupled together, and subsequently loaded or attached to a terminator. Once loaded, an alignment operation is performed which relies on a degree of free play between the applicator and the terminator. Once aligned, the applicator is fixedly attached to the terminator in a desired position via, for example, a clamping feature.

Existing solutions for connecting an applicator to a cassette are costly to manufacture and unnecessarily difficult to use. Accordingly, there is a need for a new mounting or coupling system which provides quick and easy mounting and unmounting of the applicator and the cassette, as well as provides the proper degrees of freedom necessary for the introduction and alignment of the applicator with the terminator.

SUMMARY

According to an embodiment of the present disclosure, a system for mounting a terminal applicator to a cassette containing a plurality of terminals is provided. The system includes a support plate for fixedly attaching to the applicator, and a yoke releasably attached to the support plate. The yoke and the support plate define a movable attachment therebetween providing at least one degree of freedom of the support plate relative to the yoke in an attached state. The yoke further defines a second movable attachment for mounting to the cassette with at least one degree of freedom.

A support plate for mounting a terminal applicator to a cassette containing a plurality of terminals and to a crimping press according to an embodiment of the present disclosure includes a slot formed therethrough and extending from a first end in a direction of a second end, opposite the first end. The slot is sized to receive a fastening element for fixing the position of the support plate relative to the crimping press. At least one of a protrusion or a recess of the support plate defines a mount on the second end of the body. The mount includes a resiliently mounted locking element for removably attaching the support plate to a terminal cassette. The mount provides for at least one degree of freedom of the support plate relative to the cassette when attached thereto.

According to another embodiment, a yoke for mounting an electrical terminal applicator to a cassette containing a plurality of terminals is also provided. The yoke includes a first mounting arm and a second mounting arm defining an opening therebetween for receiving a support plate of the applicator in a direction of assembly. The yoke further comprises a mount configured to selectively attach to the support plate arranged within the opening. The mount provides for at least two degrees of freedom of motion of the support plate relative to the yoke when attached thereto.

Another system for mounting an electrical terminal applicator to a cassette according to embodiments of the present disclosure includes a support plate for fixedly attaching to the applicator, and a gripping assembly associated with the cassette. The gripping assembly comprises a pair of opposing mounting arms moveable relative to one another between a closed position and an open position for releasably capturing the support plate therebetween. The gripping assembly is configured such that when the support plate is engaged between mounting arms in the closed position, the support plate retains a plurality of degrees of freedom of motion relative to the cassette.

A gripping assembly for mounting a terminal applicator to a cassette according to yet another embodiment comprises a first side defining a first mounting arm, and a second side defining a second mounting arm. The first and second mounting arms are moveable relative to one another between a closed position and an open position for releasably capturing a support plate associated with the applicator therebetween. The assembly further comprises an elastic element biasing the first and second mounting arms into the closed position, and an actuator configured to selectively bias the first and second mounting arms from the closed position to the open position against a biasing force of the elastic element.

BRIEF DESCRIPTION OF THE DRAWINGS

The invention will now be described by way of example with reference to the accompanying figures, of which.

DETAILED DESCRIPTION OF THE EMBODIMENTS

Figure 1:
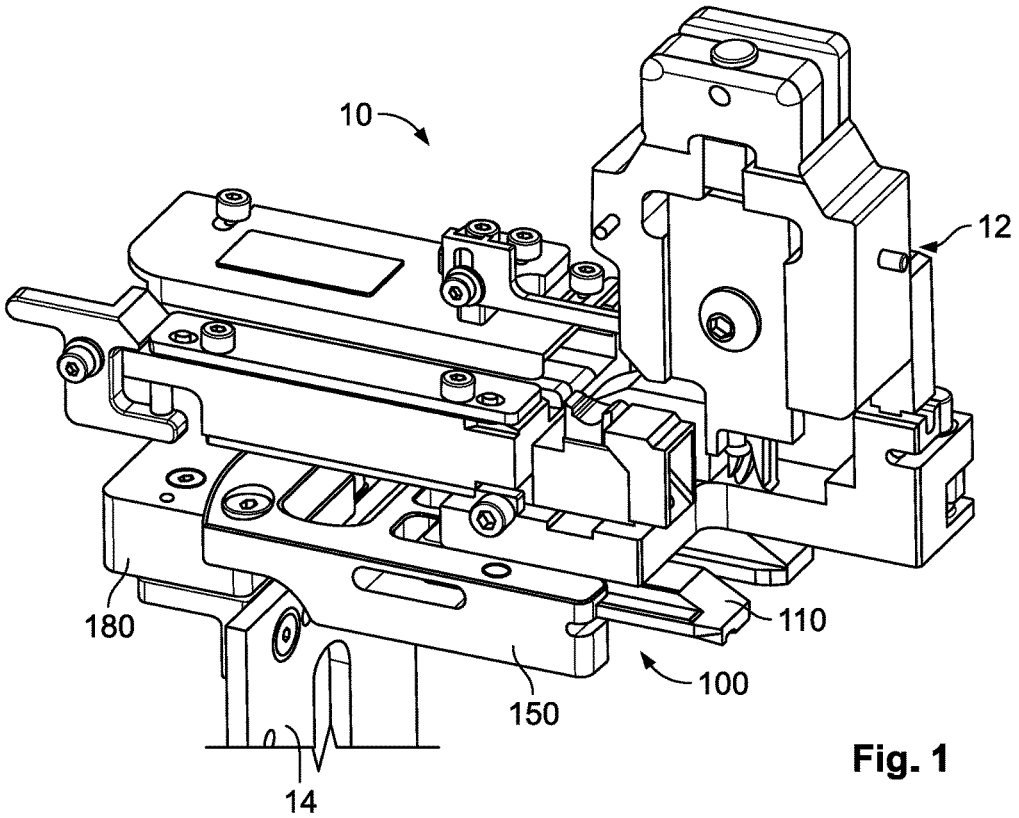
FIG. 1 is perspective view of a portion of a crimping system including a support plate assembly according to an embodiment present disclosure.

Exemplary embodiments of the invention will be described hereinafter in detail with reference to the attached drawings, wherein like reference numerals refer to like elements. The invention may, however, be embodied in many different forms and should not be construed as being limited to the embodiments set forth herein; rather, these embodiments are provided so that the present disclosure will be thorough and complete, and will fully convey the concept of the disclosure to those skilled in the art.

Figure 2:
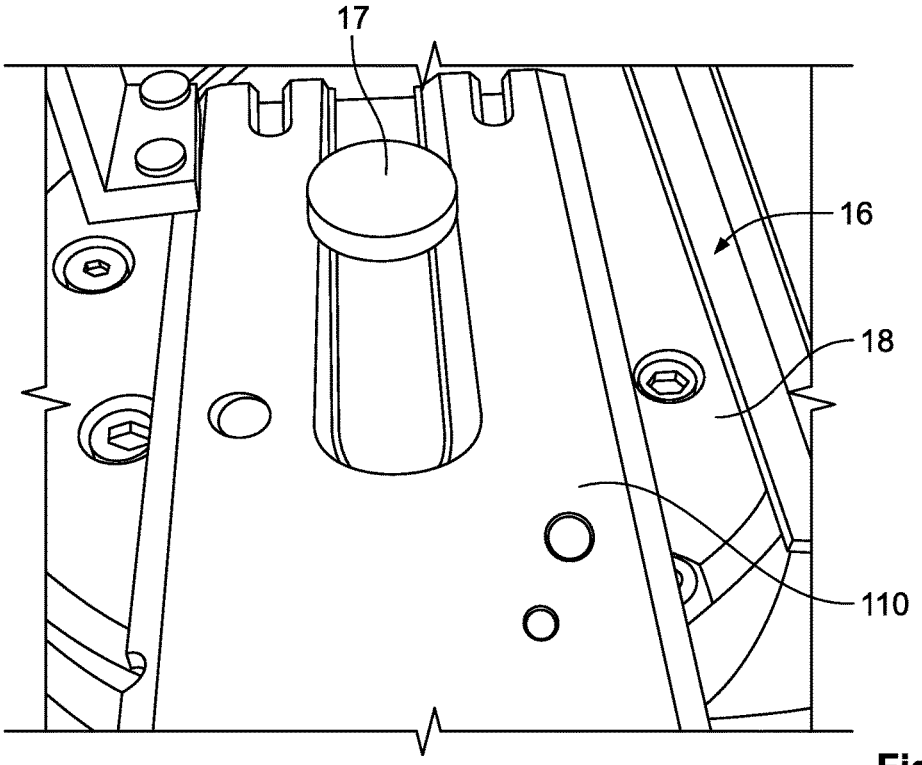
FIG. 2 is a top perspective view of a support plate according to an embodiment of the present disclosure in the process of being mounted to a crimping press.

Embodiments of the present disclosure will be described in the context of an exemplary system for crimping a terminal to a conductor. Referring to FIGS. 1 and 2, a system 10 for performing termination or crimping operations generally includes an applicator assembly or applicator 12 configured to feed a plurality of terminals contained on a reel of a cassette 14 (only a portion of which is shown) into a crimping position, for example, on an end of a conductive wire to be terminated. Once positioned, the applicator 12 is responsive to a compressive force applied via a terminator or crimping press 16, a portion of which is shown in FIG. 2, for deforming and crimping the terminal to the conductor. As shown in FIG. 1, the applicator 12 is attached to the cassette 14 via a support plate assembly 100 according to embodiments of the present disclosure. The support plate assembly includes a first member embodied as a support base or plate 110 fixedly attached to the applicator assembly, a second member embodied as a yoke plate or yoke 150 movably mounted to the support plate, and a third member embodied as a yoke mounting block 180 movably mounted to the yoke 150 and fixedly mounted to the cassette 14. With reference again to FIG. 2, in operation, the support plate 110 (as well as the attached applicator assembly and cassette) is selectively fixedly mounted to the terminator 16. In the illustrated embodiment, this is achieved via a spring loaded bolt or pin 17 axially moveable with respect to a base 18 of the terminator. As shown, the pin 17 is held upwards in an unlocked or unclamped position, wherein the support plate 110 may receive the pin 17 in a slotted aperture thereof as it is installed onto the pin in a direction of the slotted aperture. Once the support plate is in a desired position, the pin 17 may be released from the unlocked position, and biased downward and into clamping contact with the support plate 110, securing the support plate 110, and thus the applicator 12 and the cassette 14, to the terminator 16.

Figure 3:
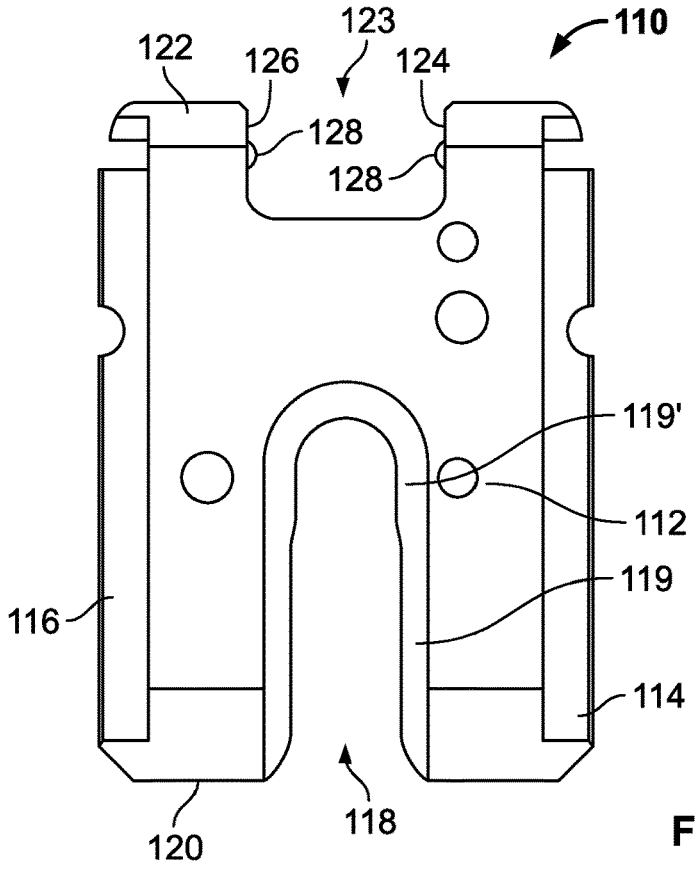
FIG. 3 is a top view of a support plate according to an embodiment of the present disclosure.
Figure 4:
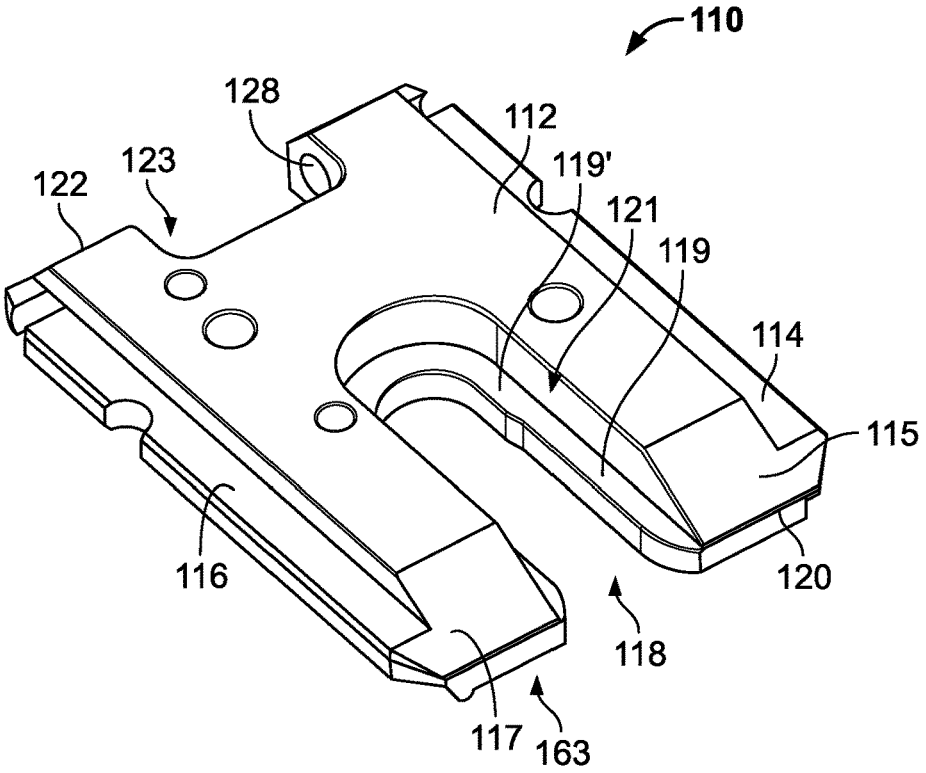
FIG. 4 is a perspective view of the support plate of FIG. 3.

Referring now to FIGS. 3 and 4, the support plate 110 includes a generally rectangular body 112 having generally parallel sides. Each lateral side of the body 112 defines a respective yoke mounting flange 114,116, embodied as recessed steps formed along each lateral side of the body and having a thickness less than a thickness of another portion of the body. The flanges 114,116 are configured to be slidably received within corresponding channel-like features of the yoke 150, as will be set forth in greater detail herein. The body 112 further defines a first terminator interface slot 118 formed in a first end 120 thereof and extending through the body in a direction generally parallel with the lateral sides of the body (i.e., in a longitudinal direction of the body). The slot 118 is configured to receive a mounting bolt or pin of a terminator therein, for example, the pin 17 of the terminator 16 shown in FIG. 2. As illustrated, the slot 118 may be defined by a stepped sidewall of the body 112 which forms a flange 119,119' extending around a perimeter of the slot and protrudes in a direction toward a center thereof. A recessed portion 121 of the slot 118 arranged above the flange 119,119' provides a space for receiving a head of a clamping bolt or pin of a terminator in a recessed manner, with an underside surface of the head contacting an opposing top surface of the flange 119,119' when the support plate 110 is locked or secured to the terminator.

As shown more clearly in FIG. 3, a portion of the slot 118 defined by the segment of the flange 119 is wider than another portion of the slot 118 defined by the segment of the flange 119'. It should be noted that the narrower portion of the slot 118 is arranged at an end thereof opposite the open end of the slot. In this way, introducing the support plate 110 onto a pin or bolt of a terminator is made easier, requiring less precision, while further translation of support plate 110 relative to the pin centers the support plate on the pin as approaches it the second closed end of the slot. Free ends of the portions of the lateral sides of the body 112 defining the slot 118 include tapered surfaces 115,117 on the top and/or bottom side of the body which taper in a direction opposite an installation direction of the support plate 110 onto a terminator pin. In this way, the support plate 110 may be more easily installed onto the terminator, as any small variations in height between the two are accommodated by these tapered flange ends.

A yoke mount or mounting feature is formed on a second end 122 of the body 112 opposite the first end 120. In the illustrated embodiment, the yoke mount is defined as a slot or recess 123 formed in the second end 122 of the body 112 in a direction toward the first end 120. Lateral sides of the body 112 defining the recess 123 include inner opposing sidewalls 124,126 facing the recess 123. Each end of the lateral sides may also taper in thickness in a direction toward the second end of the body, as illustrated. Locking features or elements 128 may be arranged or defined on the opposing sidewall 124,126. Specifically, in the illustrated embodiment, each of the locking features 128 include a spring-loaded ball detent, or ball nose spring plunger, arranged in respective apertures formed in each sidewall 124,126. As shown, a portion of each ball detent extends from the sidewalls 124,126 and into the recess 123. In other embodiments, other types of elastic or inelastic protruding or locking features may be provided without departing from the scope of the present disclosure.

Figure 5:
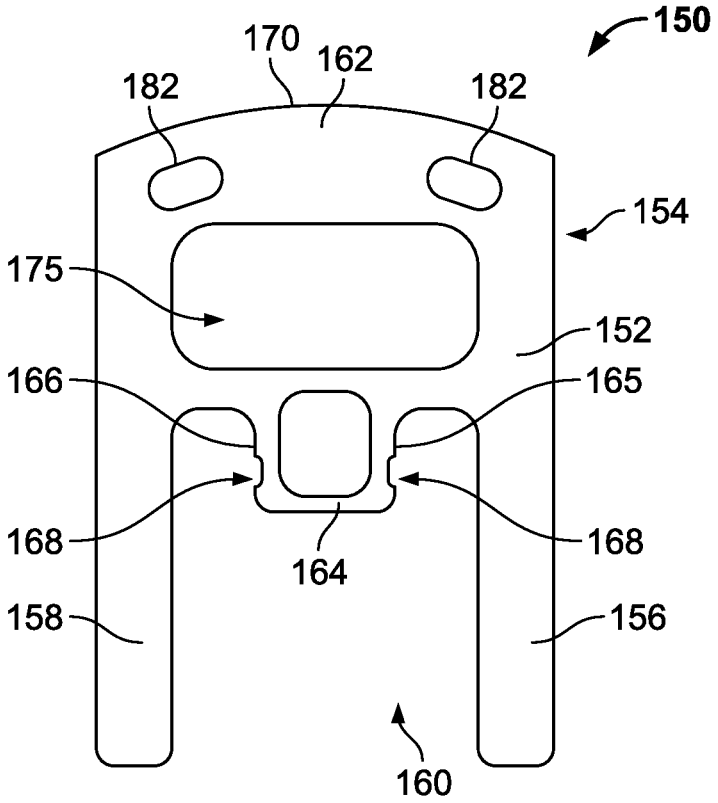
FIG. 5 is a top view of a yoke or yoke plate according to an embodiment of the present disclose.
Figure 6:
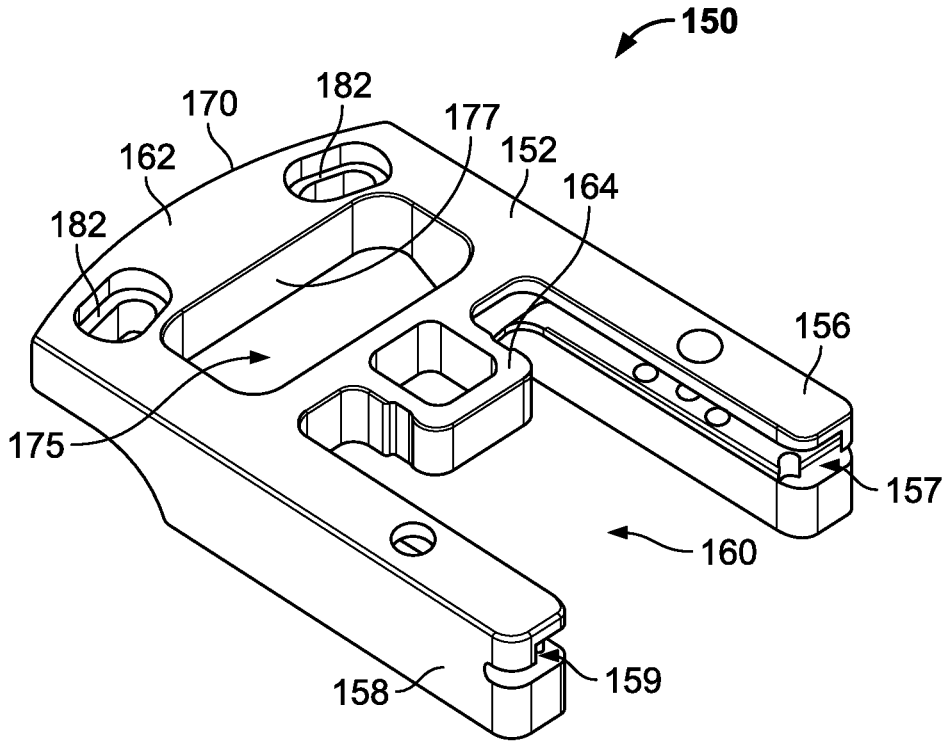
FIG. 6 is a perspective view of the yoke shown in FIG. 5.

The yoke mount, including the recess 123, is configured to engage with and attach to the yoke or yoke plate 150. Referring now to FIGS. 5 and 6, the yoke 150 comprises a generally U-shaped body 152 having a central section 154 and two mounting arms or protruding end sections 156,158 extending therefrom. An opening 160 is defined between the arms 156,158 and sized to receive the second end 122 of the support plate 110 therein. Specifically, each arm 156,158 includes a slot or channel 157,159 formed therein and sized to accept a corresponding flange 114,116 of the support plate 110 in a slidable manner. As will be described further herein, the channels 157,159 and/or the flanges 114,116 are sized so as to allow a degree of play or freedom between the yoke 150 and the support plate 110 once attached to one another, for example, in lateral directions and longitudinal directions.

The central section 154 of the body 152 includes a support plate mounting post or protrusion 164 extending into the opening 160. The mounting protrusion 164 is sized so as to be received by the yoke mount recess 123 defined in the support plate 110 as the support plate 110 is inserted into the yoke 150 in an insertion or assembly direction. Oppositely facing lateral sidewalls 165,166 of the mounting protrusion 164 feature recesses or indentations 168 formed therein and sized to receive or engage with the spring-loaded ball detents of the locking features 128 of the support plate 110 for removably and movably attaching the yoke 150 to the support plate 110. This movable attachment allows for a degree of motion between the support plate 110 and the yoke 150 in an attached state, as described with respect to FIG. 9. While the illustrated arrangement includes the resilient locking features arranged on the support plate 110, and the corresponding indents or receptacles formed on the yoke 150, the opposite arrangement may also be implemented without departing from the scope of the present disclosure. Moreover, a reversal of the arrangement of the female mount formed in the support plate 110 and male mounting protrusion of the yoke 150 may also be implemented without departing from the scope of the present disclosure.

With reference to FIGS. 4 and 6, embodiments of the present disclosure include provisions for ensuring the support plate 110 is installable onto the yoke 150 or the cassette in only one orientation. In one embodiment, this may be achieved by altering a dimension of one of the mounting flanges 114,116 of the support plate 110 and/or one of the channels 157,159 such that a given flange is insertable into only one of the channels. In other embodiments, the support plate 110 may comprise a feature extending therefrom or formed therein, such as one or more protrusions or keyways 163 which allow for only one installed orientation of the support plate 110 relative to the yoke 150.

Referring again to FIGS. 5 and 6, the body 152 of the yoke 150 further comprises features for mounting to the yoke mounting block 180. As shown, two slotted apertures or slots 182 are formed through an end 162 of the central portion 154 opposite the opening 160. In one embodiment, the slots 182 are arcuate in profile, with each arc being defined about a common axis of curvature. In this way, the yoke 150 (and support plate 110 attached thereto) may be pivotally movable relative to the yoke mounting block 180, as will be set forth in greater detail herein. Further, each slot 182 may define a counterbore (or a countersink) defined along the arc length thereof for accepting a head of a fastener configured to pass therethrough, thus ensuring the top surface of the support plate assembly 100 remains generally planar. The end 162 of the body 152 further defines a curved or arcuate exterior surface or sidewall 170, which may be defined about the same axis of curvature as the slots 182. An opening 175 is formed through the body 152 and arranged generally between the end 162 and the support plate mounting protrusion 164. A sidewall of the opening 175 comprises aperture 177 defined therethrough and extending generally in a longitudinal direction of the yoke and through the end 162 thereof. As shown in FIG. 6, at least the end 162 of the body 152 may comprise a thickness less than a thickness of than that of the arms 156,158 and/or the mounting protrusion 164.

Figure 7:
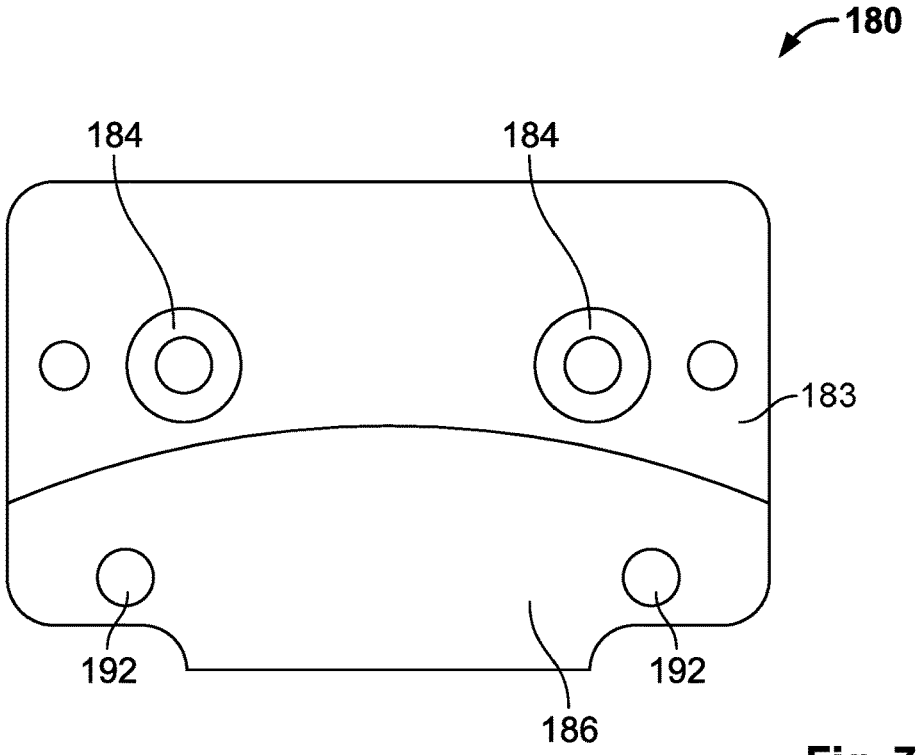
FIG. 7 is a top view of a yoke mounting block according to an embodiment of the present disclose.
Figure 8:
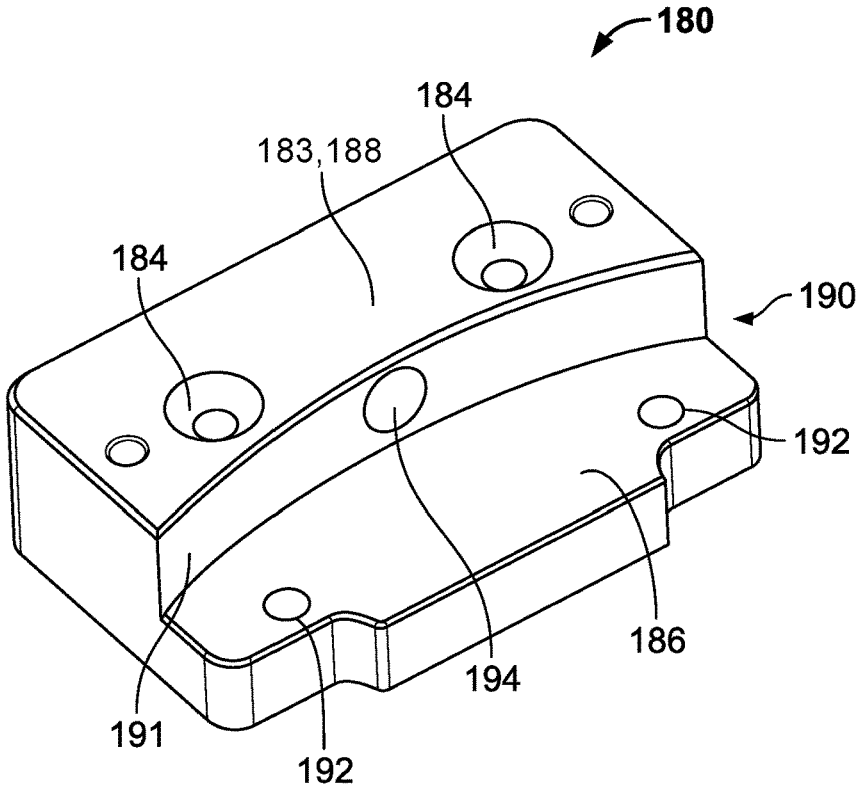
FIG. 8 is a perspective view of the yoke mounting block shown in FIG. 7.

Referring now to FIGS. 7 and 8, the yoke mounting block 180 includes a body 183 having provisions for fixedly mounting to a cassette, for example, the portion of the cassette 14 shown in FIG. 1. In the exemplary embodiment, these features include countersunk through holes 184 configured to receive fasteners for attaching to a cassette. The body 183 further comprises a stepped profile, wherein a flange portion 186 extends from a main body portion 188. The flange portion 186 defines a recessed area 190 for receiving at least the thinned end portion 162 of the yoke 150. Threaded holes 192 are formed on the flange portion 186 for receiving fasteners engaged through the arcuate slots 182 of the yoke 150. The sidewall 191 defining the recessed area 190 is arcuate is profile, and comprises a radius of curvature generally equal to and/or coaxial with that of the slots 182 and/or the arcuate exterior surface 170 of the yoke 150. In this way, the yoke 150 is pivotable and/or rotatable with respect to the mounting block 180, but fixed thereto in lateral and longitudinal directions of relative motion. The yoke mounting block 180 further defines an aperture 194 formed in the sidewall 191 of the recessed area 190. The aperture 194 may be axially aligned with the aperture 177 of the yoke 150, such that a moveable end of a spring-loaded ball plunger 200 (see FIG. 9) extending through the aperture 177 is engageable with the aperture 194. The apertures 177,194 are formed such that, once axially aligned, the yoke 150 is aligned or centered with respect to the yoke mounting block 180, with the ball plunger 200 selectively locking the yoke in this position.

Figure 9:
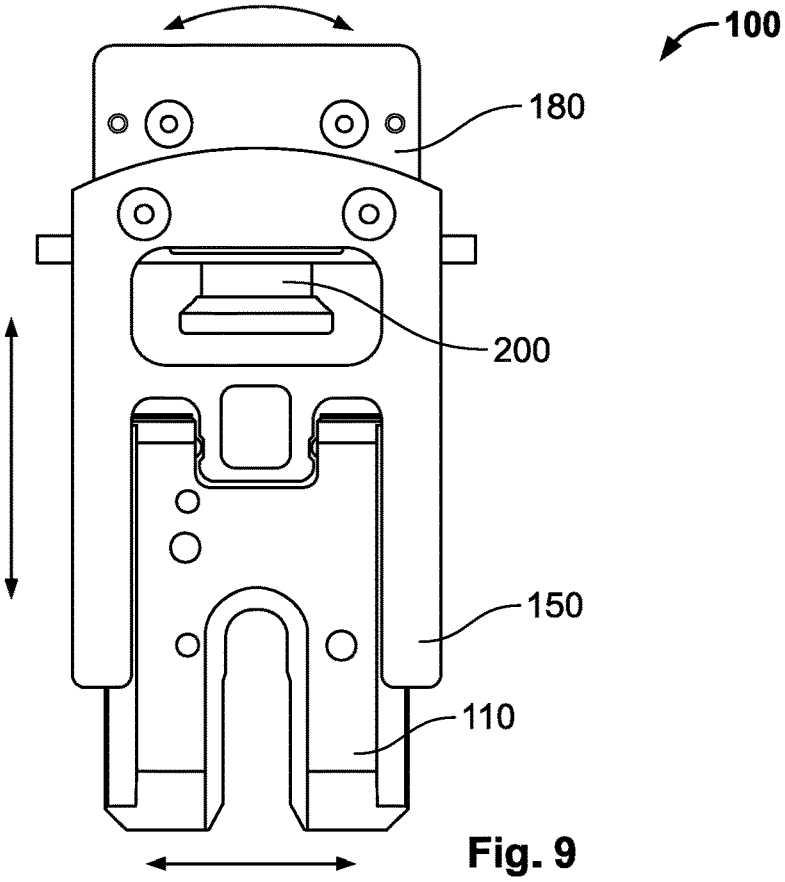
FIG. 9 is a top view of the support plate assembly of FIG. 1.
Figure 10:
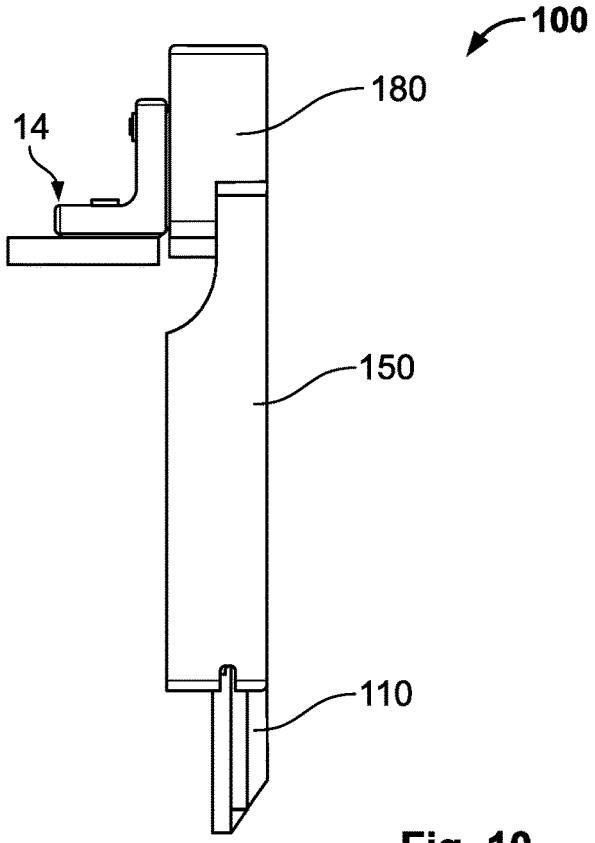
FIG. 10 is a side view of the support plate assembly of FIG. 9.

Referring now to FIGS. 9 and 10, the support plate assembly 100 is shown in an assembled state as it may be prior to its engagement with a terminator. As illustrated via arrows, the above-described support plate-to-yoke and yoke-to-mounting block attachment mechanisms permit a plurality of degrees of freedom between the yoke mounting block 180 and the support plate 110 and/or the yoke 150. Specifically, the above-described ball detent mounting provides the support plate with a limited amount of play or translation in the longitudinal directions (i.e., in an insertion direction and a removal direction), as well as in the lateral or side-to-side directions and within the channels defined by the yoke. Likewise, the arcuate slots of the yoke and the correspondingly-shaped recess of the mounting block allows the yoke and support plate to pivot relative to the mounting block, and thus relative to the cassette mounted thereto. As described above, these at least three degrees of freedom of motion ensure that a proper alignment of the applicator assembly 12 relative to a terminator may be achieved prior to fixing the applicator assembly to the terminator via the above described clamping operation. Further, the support plate assembly according to embodiments of the present disclosure is easily separable, and more specifically, the yoke may be easily and quickly removed from the support plate (i.e., via the application of a tension force to overcome the resilient ball detent engagement). In this way, exchanging a cassette holding one type of terminal, for that containing another type of terminal, for example, is more easily achieved compared to arrangements of the prior art.

FIGS. 11-17 illustrate additional embodiments of the present disclosure useable with the above-described crimping system 10 of FIG. 1. It should be understood that, where applicable, all features of the preceding embodiments may be utilized in combination with the features shown and described with respect to the embodiments of FIGS. 11-17, without departing from the scope of the present disclosure. However, detailed descriptions of such applicable features are not necessarily repeated herein.

Figure 11:
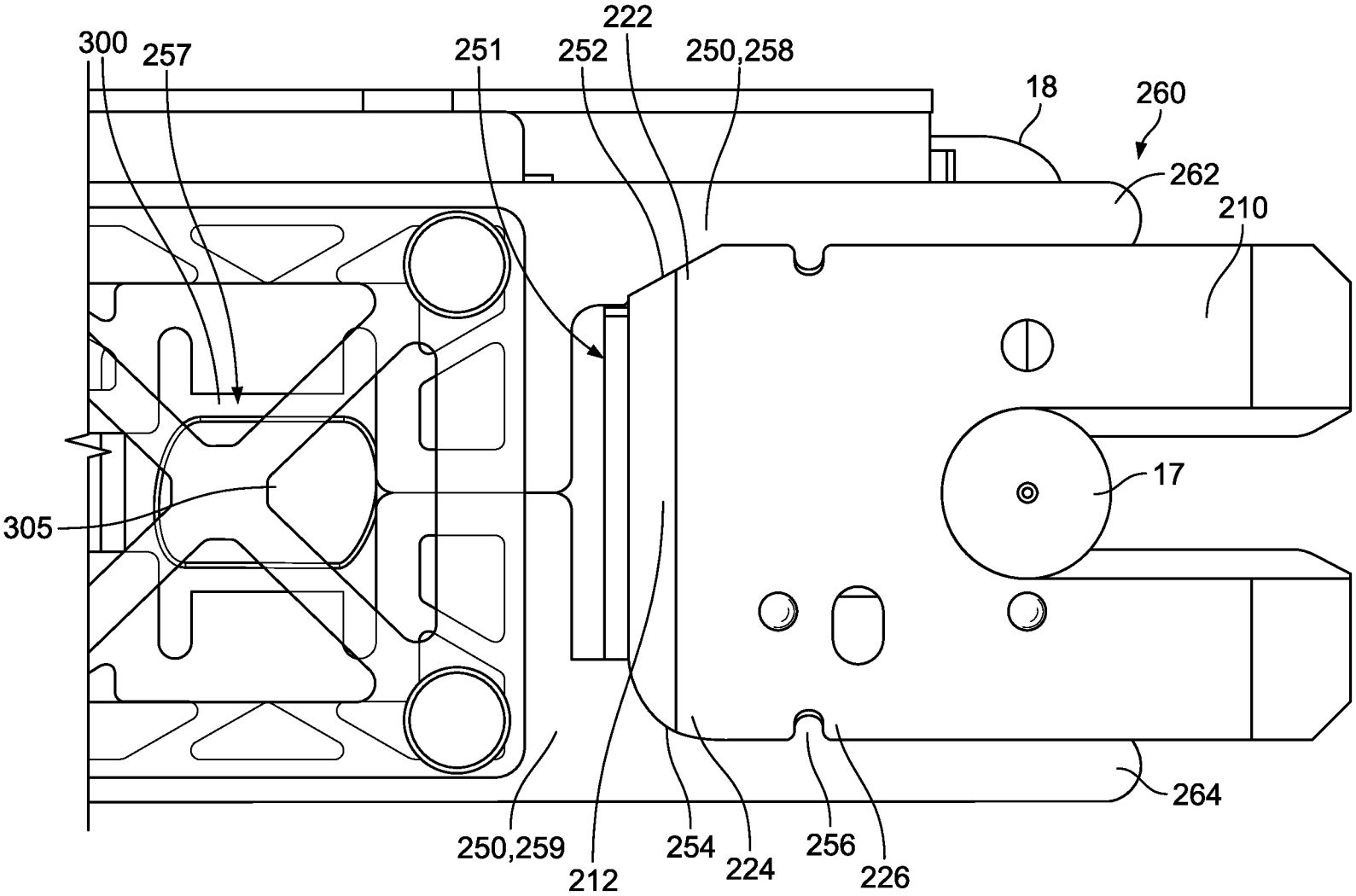
FIG. 11 is a top view of a support plate assembly according to another embodiment of the present disclosure in a closed or contracted position.

Referring generally to FIG. 11, a support plate 210 according to another embodiment of the present disclosure is selectively held within a closed gripping assembly (or yoke) 250. The support plate 210 defines one or more keying features, including an exterior chamfered corner 222 and an exterior rounded corner 224. The keying features are formed or defined on a mating end 212 of the support plate 210 and engage with corresponding keying features of the gripping assembly 250. The support plate 210 may further define a pair of optional retaining features or recesses 226 formed on lateral sides thereof and configured to receive corresponding features of the gripping assembly 250. As shown throughout the figures, the mating end 212 of the support plate 210 may be tapered in both width and thickness. The support plate 210 may further includes features similar to those of the support plate 110, including lateral mounting flanges defining a stepped slot for receiving the spring loaded bolt or pin 17, the details of which are not repeated herein for the purpose of brevity.

Still referring to FIG. 11, in an installed position, the support plate 210 is received within a complementary opening or cavity 251 defined by the gripping assembly 250. The gripping assembly 250 comprises corresponding complementary keying features, including an interior chamfered corner 252 and an interior rounded corner 254 defining the cavity 251 thereof for engaging with the keying features 222,224 of the support plate 210. The gripping assembly 250 further defines an optional pair of retention features, embodied as protrusions 256 for engaging with the complementary retaining recesses 226 of the support plate 210. Accordingly, if fitted with retaining features, the gripping assembly 250 will only fully engage with and hold a support plate that is properly positioned within the cavity 251. Likewise, the corresponding or matching keying features, may be used to only allow for the mating of a cassette associated with the gripping assembly 250 to a predetermined support plate and/or applicator. Thus, cassettes may be paired only with predetermined or designated terminators, ensuring only desired combinations may be assembled in the field.

The gripping assembly 250 comprises an expandable jaw or gripping end 260, with opposing sides 258,259 thereof defining a respective one of a pair of mounting arms 262,264. The sides 258,259 and mounting arms 262,264 are moveable relative to one another for selectively opening (see FIG. 15) and closing (see FIG. 16) the gripping assembly 250. In one embodiment, the gripping assembly 250 may include an actuator 300 (e.g., a rotary actuator) having a selectively rotatable cam or head 305 fixed thereto and arranged within an opening 257 defined between the sides 258,259 of the gripping assembly. The cam 305 is oblong, such that in the illustrated orientation, its minor diameter fits between lateral sides of the opening 257, and the sides 258,259 of the gripping assembly 250 remain biased into an abutting or closed position under the force of a spring or other elastic biasing element (see FIG. 12). The cam 305 may be rotated within the opening 257 (e.g., ninety degrees) for engaging the opening across its major diameter and biasing or urging the sides 258,259 into an open position or expanded position. In the open position, the gripping member 250 may receive the support plate 210 between the mounting arms 262,264 thereof in a direction of assembly or insertion. Once installed, the gripping assembly 250 may be closed, as shown in FIG. 11, and the optional retention features 226,256 engaged for securing the support plate 210 relative to the gripping assembly along an axis corresponding to the insertion or assembly direction.

Figure 12:
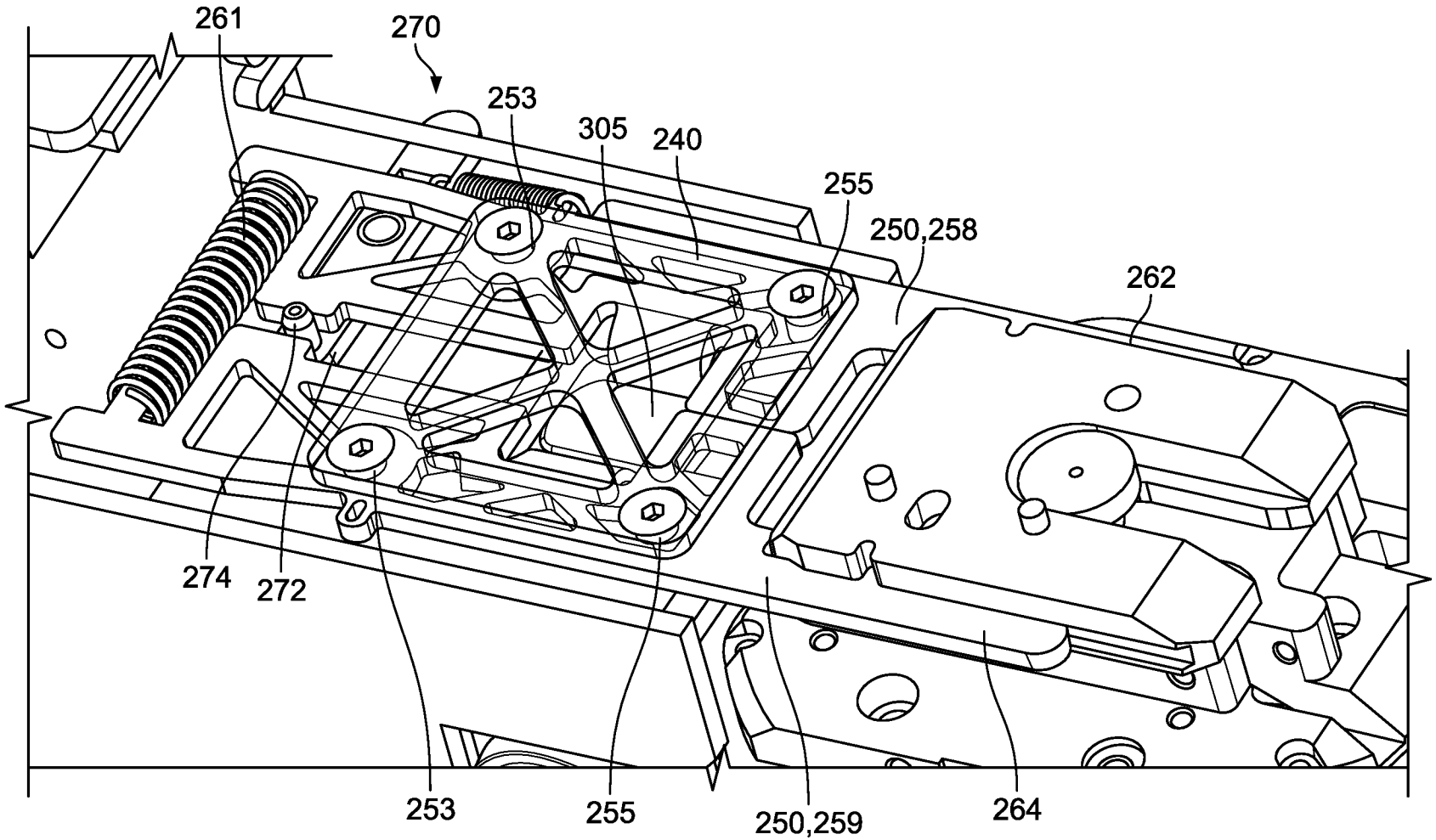
FIG. 12 is a perspective view of the support plate assembly of FIG. 11 with a locking mechanism thereof in a locked position.

As shown in FIG. 12, each side 258,259 of the gripping assembly 250 is pivotally mounted to a base thereof about respective pivot points 253, with the illustrated additional mounting points 255 comprising slotted openings, permitting the arms 262,264 to pivot relative to one another in response to the rotation of the cam 305. See FIGS. 15 and 16. An optional brace 240 may be provided for mechanically tying the mounting points 253,255 together. Still referring to FIG. 12, a rear protruding end of each side 258,259 engages with and supports an elastic element arranged therebetween, such as a compression spring 261. The compression spring 261 acts to bias each arm 262,264 into the illustrated closed position via its elastic return force spreading the rear ends of the sides 258,259 generally away from one another.

In the illustrated closed position, the support plate 210 retains multiple degrees of freedom of movement relative to the gripping assembly 250, including in each of the directions indicated in FIG. 9. For example, the channels described above with respect to the preceding embodiments may be defined within the mounting arms 262,264 of the gripping assembly 250, providing for multiple degrees of relative movement of the support plate 210. Likewise, as the mounting arms 262,264 are held in the closed position via an elastic element, an associated elastic closing or biasing force may be selected so as to allow the support plate 210 to bias the arms 262,264 generally apart in response to sufficient force placed thereon, In this way, the support plate 210 is permitted to float within the gripping assembly 250 during the above-described alignment operations, and prior to the fixation of the support plate 210 to the base 18 of the terminator via the pin 17, as described in detail above.

Figure 13:
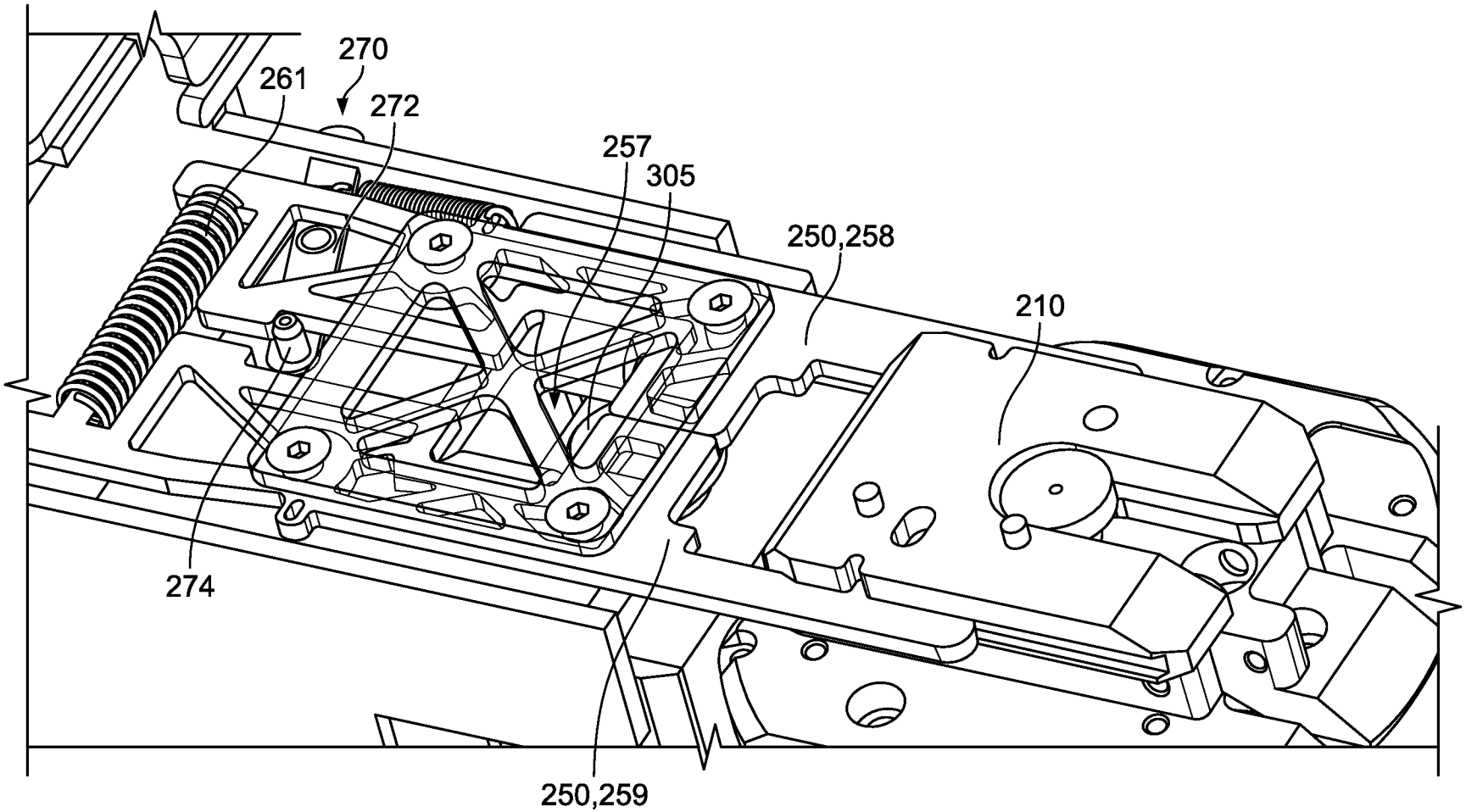
FIG. 13 is a perspective view of the support plate assembly of FIGS. 11 and 12 with the locking mechanism in an unlocked position.

A locking mechanism 270 is provided for selectively preventing the opening of the arms 262,264. Specifically, in the exemplary embodiment, the locking mechanism 270 include a pivoting lever 272 having a free end which may be actuated by a user, and a working end including a blocking protrusion 274 extending normally therefrom and into a space between the sides 258,259 of the gripping assembly 250. With the blocking protrusion 274 in the locked position illustrated in FIG. 12, the rear ends of each side 258,259 are prevented from being further biased toward one another and against a force applied by the spring 261, thus preventing the arms 262,264 from being biased away from one another into an open position. As shown in FIG. 13, with the support plate 210 in a partially installed position with respect to the gripping assembly 250, the lever 272 may be biased or rotated into an unlocked state or position by a user or by mechanical actuation. In the unlocked position, the protrusion 274 no longer prevents the sides 258,259 of the gripping assembly 250 from converging in response to the actuation of the cam 305, or in response to the support plate 210 biasing the arms 262,264 outward, such as during an alignment operation.

Figure 14:
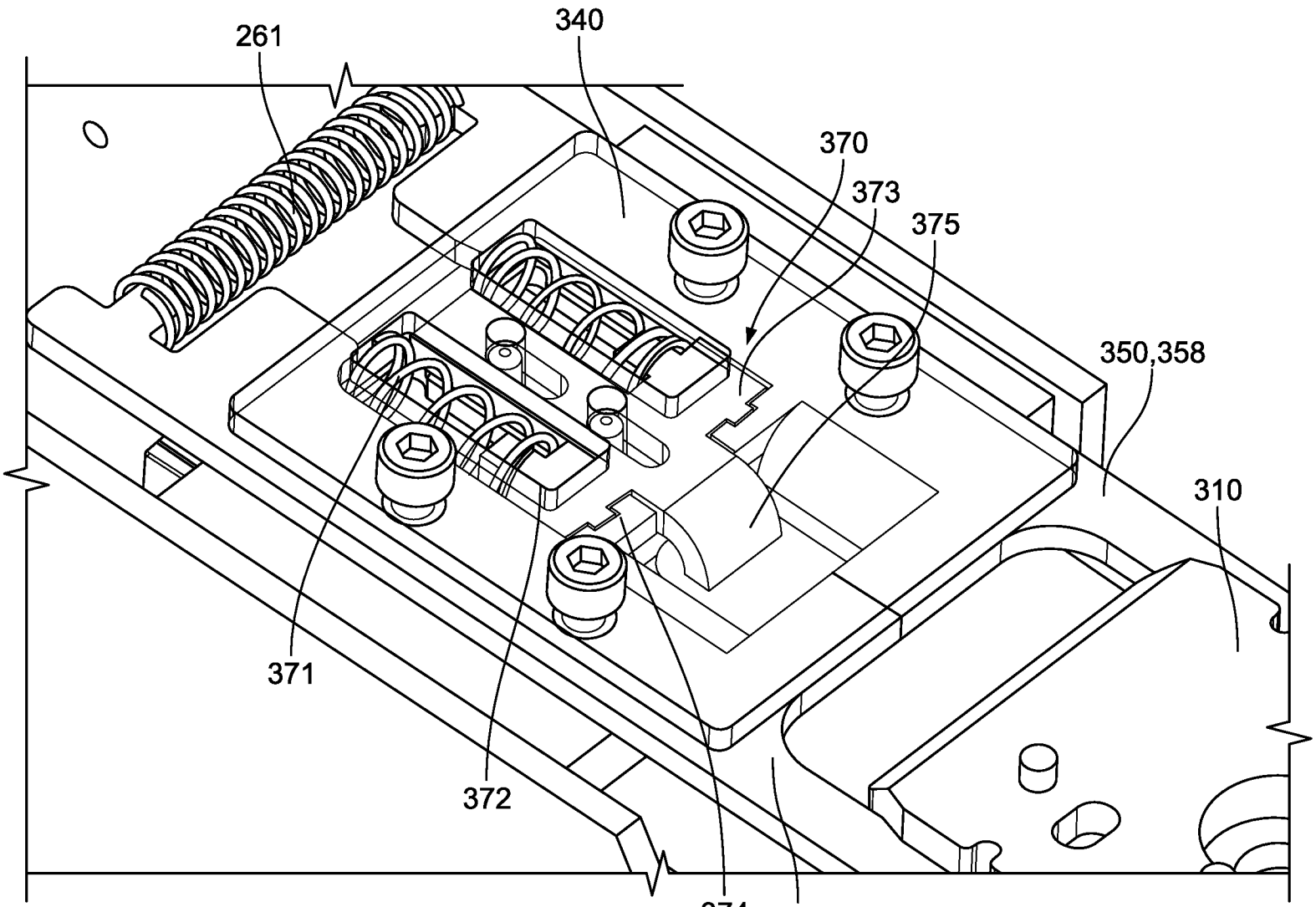
FIG. 14 is a partial perspective view of a support plate assembly and locking mechanism according to another embodiment of the present disclosure.

FIG. 14 illustrates a gripping assembly 350 including a locking mechanism 370 according to another embodiment of the present disclosure, The locking mechanism 370 includes a moveable slide 372 mounted between sides 358,359 of the gripping assembly 350. The slide 372 is biased into a locked position via a plurality of elastic elements or springs 371. In the locked position, locking protrusions 373 of the slide engage correspond locking recesses 374 of each side 358, 359 of the gripping assembly 350, preventing their relative movement in the locked position. In response to the installation of the cassette onto the applicator, the slide 372 is biased rearwardly as indicated by, for example, engagement of a protruding tab 375 thereof and the cam 305 or other component. The motion of the slide 372 disengages the locking protrusions 373 and recesses 374, permitting the opening and closing of the gripping assembly 350 for selectively engaging with a supporting plate 310. The gripping assembly 350 may further comprise a brace 340 arranged over the slide 372, aiding in retaining the position of the slide, the springs 371 and the sides 358,359.

Figure 15:
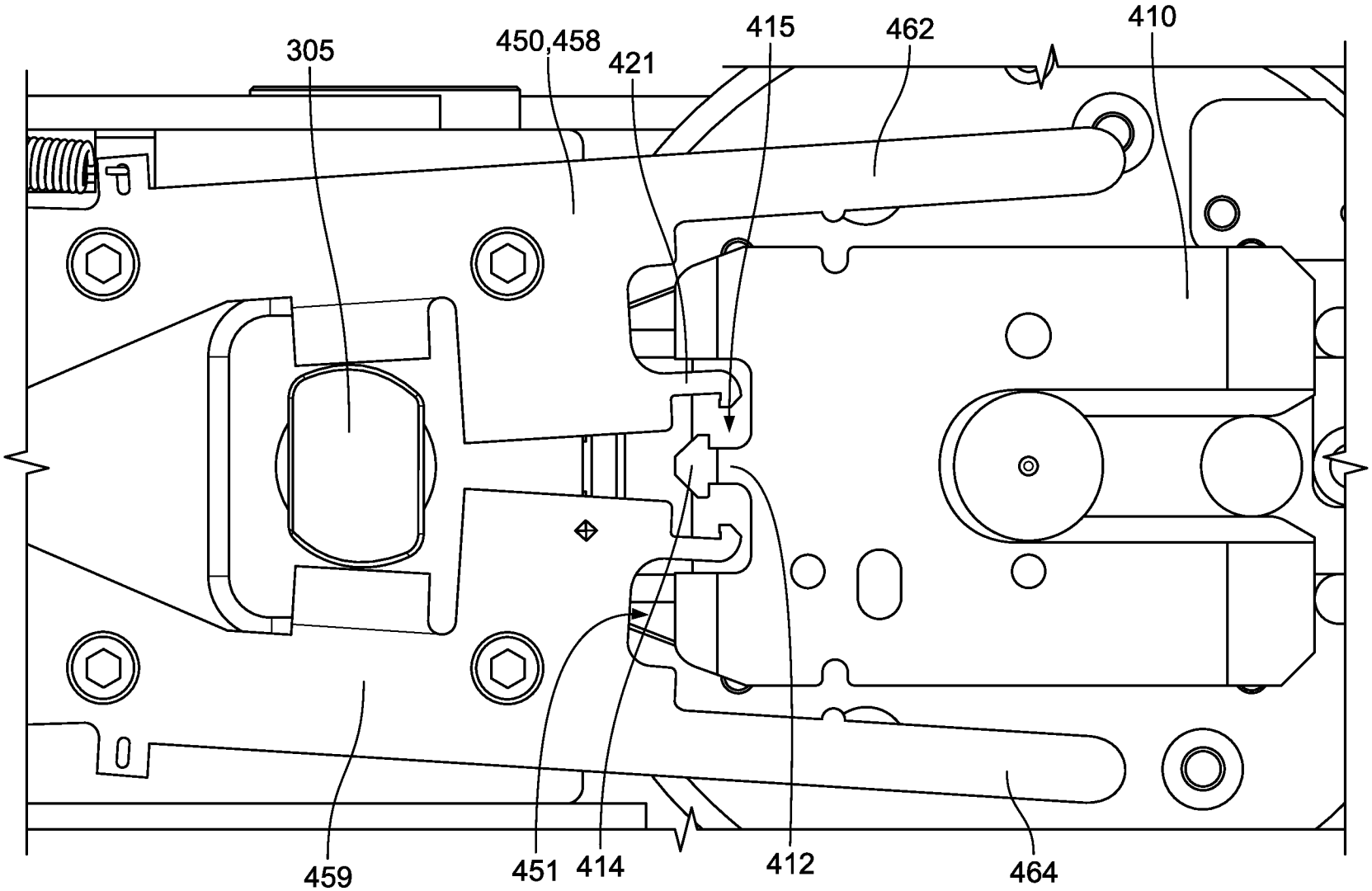
FIG. 15 is a top view of a support plate assembly according to another embodiment of the present disclosure in an open or expanded position.

Referring now to FIG. 15, a gripping assembly 450 according to another embodiment of the present disclosure is shown in the open or expanded position in response to the engagement of the cam 305 with reach side 458,459 of the assembly. Each side 458,459 defines a locking feature, including respective hook-shaped protrusions 421 extending from an interior face of a receiving space 451 defined between arms 462,464 of the gripping assembly 450. The exemplary support plate 410 includes a corresponding locking feature, embodied as a protruding stem 412 and associated head 414 extending from a recess 415 formed in an opposing end face the support plate. As shown, the recess 415 is sized so as to accommodate the protrusions 421 as they are biased between the illustrated open and closed positions shown in FIGS. 15 and 16.

Figure 16:
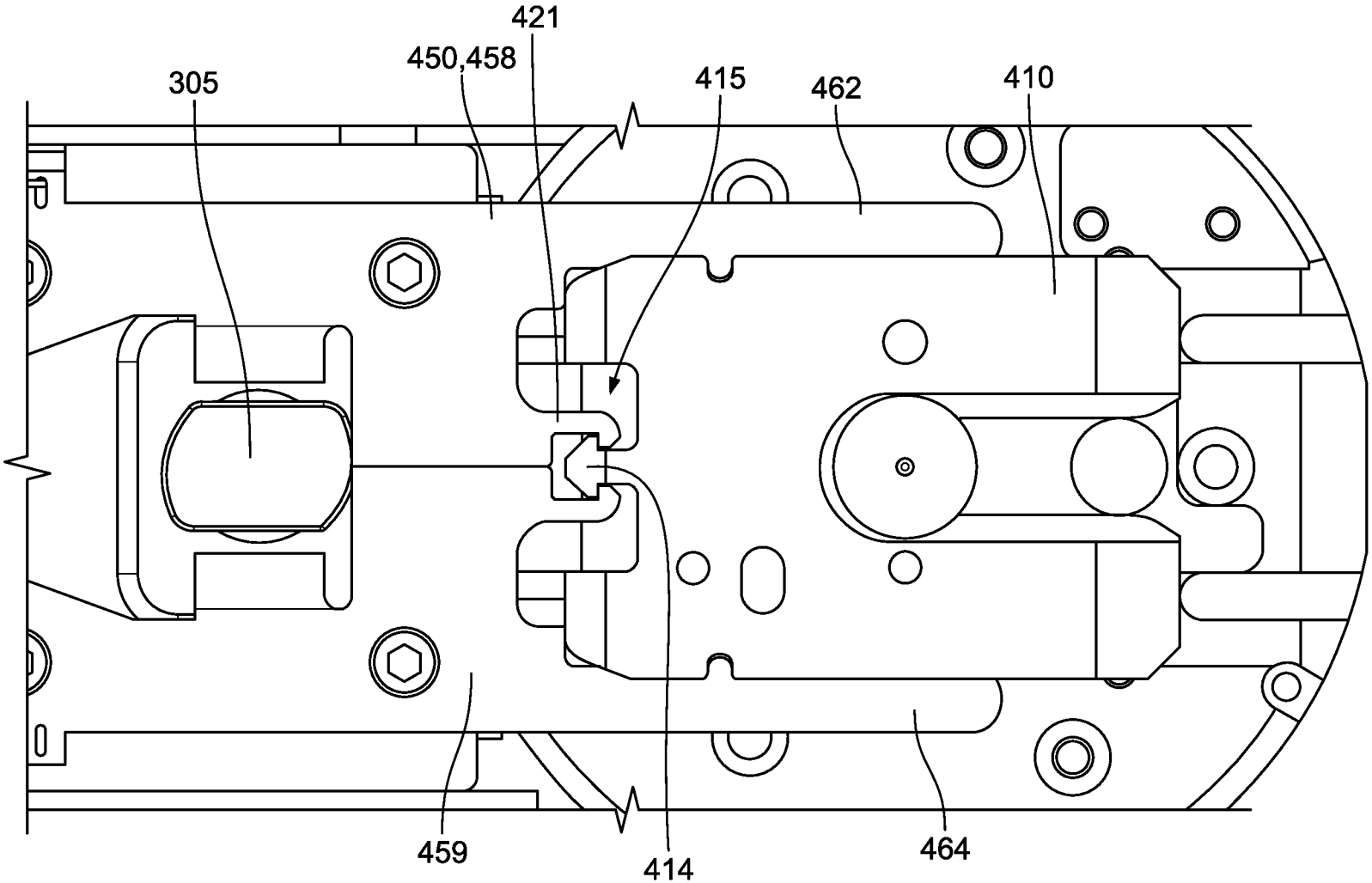
FIG. 16 is a top view of the support plate assembly of FIG. 15 in an closed or contracted position.

The locking feature of the support plate 410 and the locking feature of the gripping assembly 450 are configured such that, with the support plate in a fully installed position within the receiving space, closing the gripping assembly via the actuation of the cam 305 as shown in FIG. 16, captures the head 414 of the locking feature within a recess defined between the protrusions 421. In the closed position, the support plate 410 may be permitted some degree of motion along an axis of insertion, while excess motion is inhibited via the respective profiles of the head 414 and the protrusions 421. The support plate 410 is further provided with additional freedom of movement against the above-described spring bias holding the arms 462,464 in the closed position.

Figure 17:
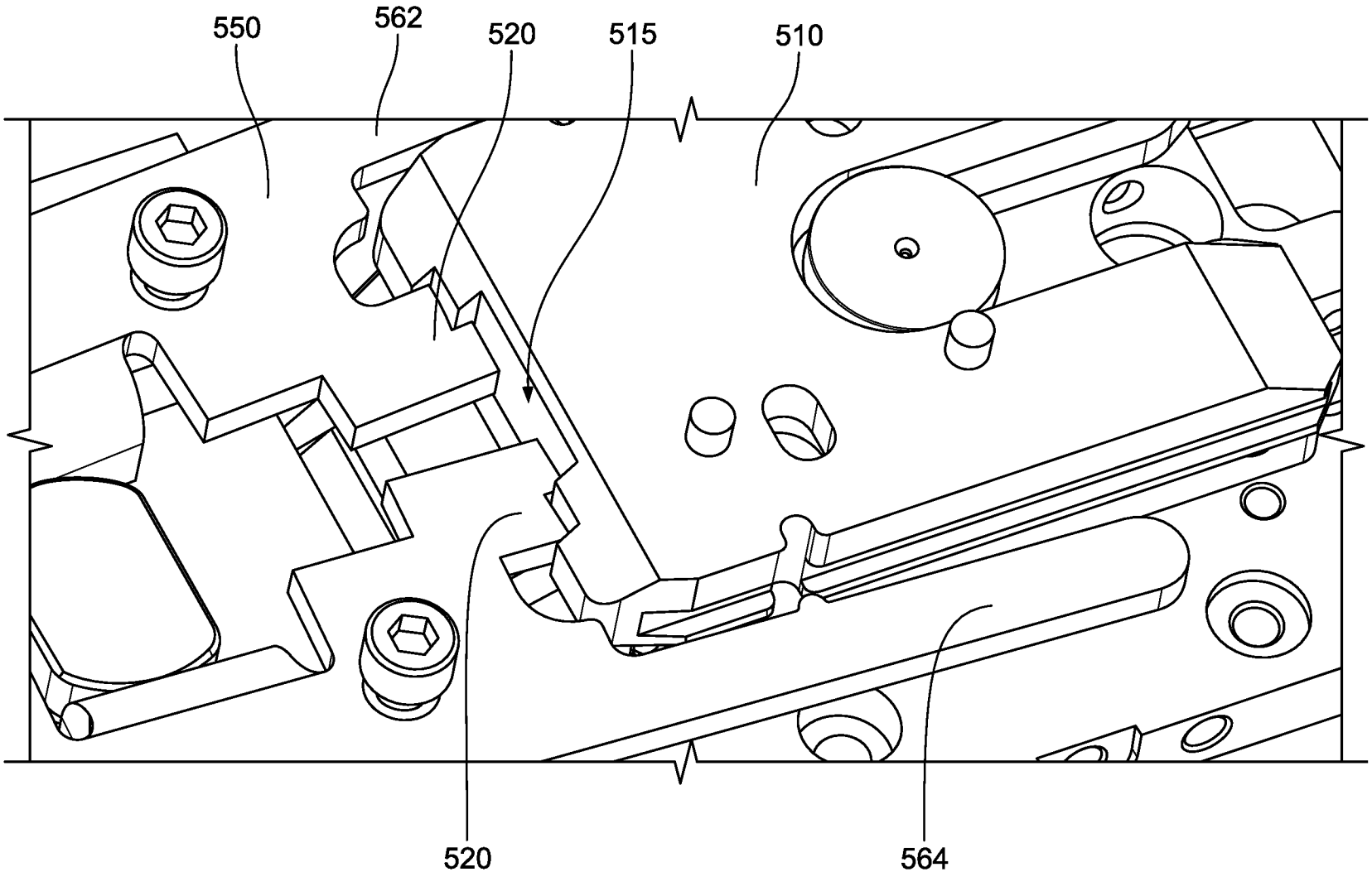
FIG. 17 is a perspective view of a support plate assembly according to another embodiment of the present disclosure.

The embodiment of FIG. 17 includes a gripping assembly 550 and a support plate 510. The support plate 510 includes a keying recess 515 sized to receive protruding ends 520 of each side 558,559 of the gripping assembly 550. The recess 515 and ends 520 are sized so as to be complementary with one another, permitting the support plate 510 to be fully installed between the arms 562,564 of the gripping assembly 550 in an insertion direction, with their respective opposing surfaces abutting one another in the installed state. Likewise, the recess 515 and the ends 520 further define surfaces opposing one another in directions transverse to the insertion direction, or laterally. In this way, the complementary recess 515 and ends 520 may be adapted to limit, or prevent, the opening or closing of the arms 562,564. In this way, further selective keying configurations between gripping assemblies and support plates may be achieved, whereby the functionality of the gripping assembly may be inhibited or otherwise disabled if associated with a particular support plate. As set forth above with respect to the remaining embodiments, the embodiment of FIG. 17 also permits relative motion between the plate 510 and the gripping assembly 550 in response to sufficient force acting thereon for biasing the arms 562,564 outward during alignment operations, and/or free-space defined between the channels and flanges of the arms and plate, as described above.

As described above, these degrees of freedom ensure that a proper alignment of an associated applicator assembly relative to a terminator may be achieved prior to fixing the applicator assembly to the terminator via the above described clamping operation. Further, the support plate remains quickly and easily separable from the gripping assembly via the opening of the opposing gripping arms. In this way, exchanging a cassette holding one type of terminal, for that containing another type of terminal, for example, is more easily achieved compared to arrangements of the prior art.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range.

Also, the indefinite articles "a" and "an" preceding an element or component of the invention are intended to be nonrestrictive regarding the number of instances, that is, occurrences of the element or component. Therefore "a" or "an" should be read to include one or at least one, and the singular word form of the element or component also includes the plural unless the number is obviously meant to be singular.

The term "invention" or "present invention" as used herein is a non-limiting term and is not intended to refer to any single embodiment of the particular invention but encompasses all possible embodiments as described in the application.

What is claimed is:

1. A system for mounting an electrical terminal applicator to a cassette containing a plurality of terminals, comprising:

a support plate for fixedly attaching to the applicator; and a gripping assembly associated with the cassette and including a pair of opposing mounting arms moveable relative to one another between a closed position and an open position for releasably capturing the support plate between the mounting arms, wherein, when the support plate is captured between the mounting arms in the closed position, the support plate retains a plurality of degrees of freedom of motion relative to the cassette.

2. The system of claim 1, wherein the support plate defines a slot configured to receive a corresponding fastening element associated with the applicator for fixing the position of the support plate relative to the applicator.

3. The system of claim 1, wherein the gripping assembly further comprises a first side defining a first mounting arm of the pair of mounting arms, and a second side defining a second mounting arm of the pair of mounting arms, the first side and the second side being rotatable with respect to one another for moving the mounting arms between the closed position and the open position.

4. The system of claim 3, wherein the gripping assembly further comprises an elastic element biasing the mounting arms into the closed position.

5. The system of claim 4, wherein the elastic element comprises a compression spring arranged between the first side and the second side of the gripping assembly.

6. The system of claim 5, wherein the gripping assembly further comprises a locking mechanism for selectively fixing the mounting arms in the closed position.

7. The system of claim 5, further comprising an actuator operative to bias the first mounting arm and the second mounting arm from the closed position to the open position against a biasing force of the elastic element.

8. The system of claim 7, wherein the actuator comprises a rotary actuator for rotating a cam, the cam engaging with the first side and the second side of the gripping assembly for biasing the mounting arms into the open position.

9. The system of claim 1, wherein the gripping assembly is sized to receive the support plate in only a single orientation.

10. The system of claim 9, wherein the gripping assembly and the support plate define complementary keying features engaging with the support plate in an installed position within the gripping assembly.

11. The system of claim 10, wherein the keying features define surfaces opposing in a direction generally transverse to an insertion direction of the support plate within the gripping assembly.

12. The system of claim 11, wherein the keying features define surfaces opposing in a direction generally parallel to the insertion direction.

13. The system of claim 10, wherein with the support plate arranged between the mounting arms of the gripping assembly, the keying features prevent one of the movement of the mounting arms into the closed position, or the movement of the mounting arms into the open position.

14. The system of claim 10, wherein the keying features prevent motion of the support plate in a direction opposite an insertion direction of the support plate with the mounting arms of the gripping assembly in the closed position.

15. The system of claim 10, wherein the keying features comprise a hook shaped protrusion defined on each of the first side and the second side, and a protruding head defined on the support plate, the protruding head being captured between the hook shaped protrusions with the mounting arms in the closed position.

* * * * *